US008955198B2

(12) United States Patent
Carnevali

(10) Patent No.: US 8,955,198 B2
(45) Date of Patent: Feb. 17, 2015

(54) RELEASABLE STRAP MOUNT

(76) Inventor: Jeffrey D. Carnevali, Seattle, WA (US)

( * ) Notice: Subject to any disclaimer, the term of this patent is extended or adjusted under 35 U.S.C. 154(b) by 360 days.

(21) Appl. No.: 13/219,693

(22) Filed: Aug. 28, 2011

(65) Prior Publication Data

US 2013/0047384 A1 Feb. 28, 2013

(51) Int. Cl.
*B65D 63/10* (2006.01)

(52) U.S. Cl.
CPC ..... *B65D 63/1063* (2013.01)
USPC ..... 24/16 PB; 24/17 A; 24/17 AP; 248/74.3

(58) Field of Classification Search
USPC ..... 24/16 PB, 16 R, 17 A, 17 AP, 35 P, 68 R, 24/265 R; 248/74.3; 292/325
See application file for complete search history.

(56) References Cited

U.S. PATENT DOCUMENTS 3,965,538 A * 6/1976 Caveney et al. ..... 24/16 PB
4,458,385 A * 7/1984 Espinoza ..... 24/16 PB
4,510,650 A * 4/1985 Espinoza ..... 24/16 PB
4,862,561 A * 9/1989 Lichtenberg ..... 24/16 PB
4,882,813 A * 11/1989 Nakamura ..... 24/16 PB
5,042,114 A * 8/1991 Parrish ..... 24/16 PB
5,224,244 A * 7/1993 Ikeda et al. ..... 24/16 PB
5,230,541 A * 7/1993 Nowak ..... 292/288
5,377,510 A * 1/1995 Smith ..... 70/16

* cited by examiner

*Primary Examiner* — William Gilbert
(74) *Attorney, Agent, or Firm* — Charles J. Rupnick

(57) ABSTRACT

A releasable strap mount having a strap body and a cooperating locking head. The strap body is elongated between first and second ends with an outer interlock engagement member positioned adjacent to the first end. The locking head has an interface surface and an opposite external interconnect, and a passageway extended therethrough that is sized to accept the strap body lengthwise therethrough. The locking head also has an interlock member for releasably interlocking with the outer interlock engagement member of the strap body within the passageway. A releasable rotation coupling is formed between the locking head and the second end of the strap body. The strap body has a plurality of intervening coupling members spaced at intervals along a length thereof, and the strap body is divisible adjacent to each of the intervening coupling members between the intervening coupling member and its second end for shortening the strap body.

14 Claims, 4 Drawing Sheets

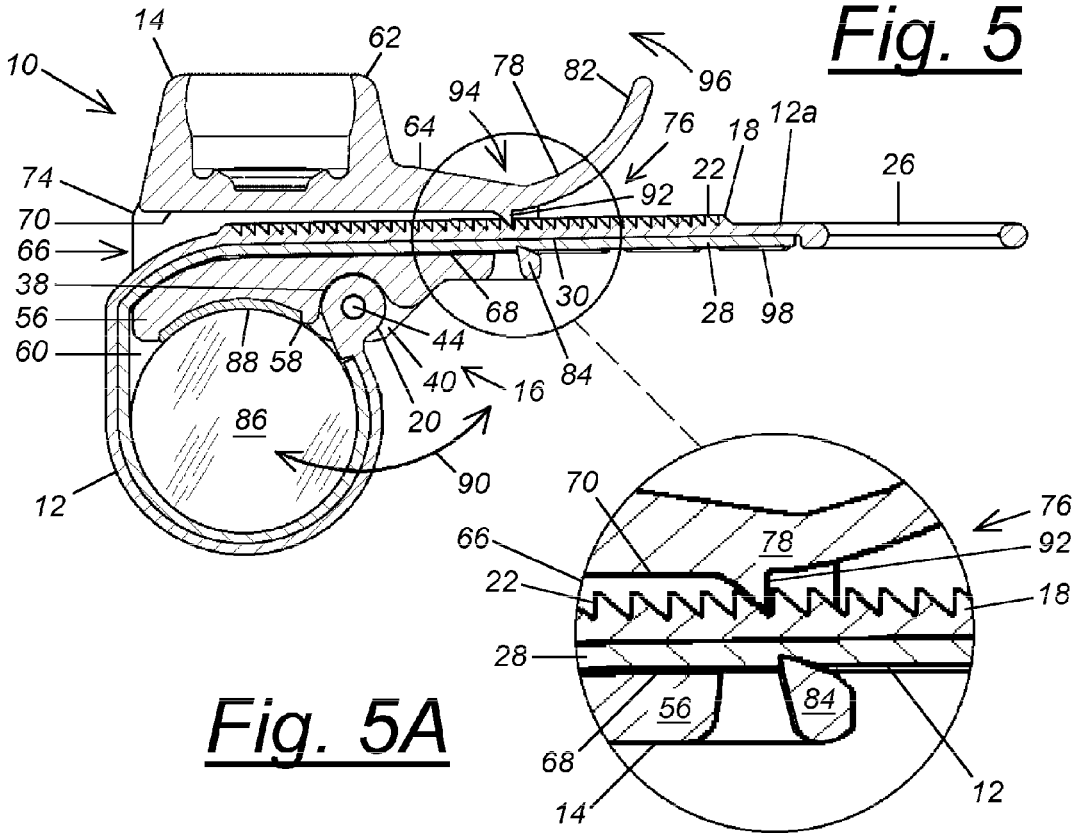
Fig. 5
Fig. 5A
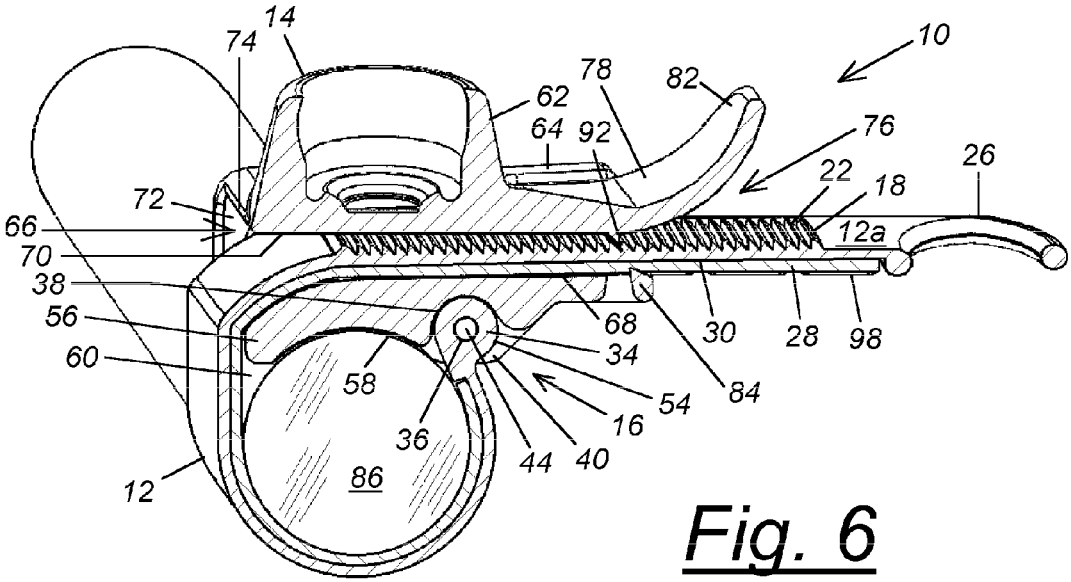
Fig. 6

RELEASABLE STRAP MOUNT

FIELD OF THE INVENTION

The present invention relates generally to strap mounts for connecting to pipes, tubes, and like objects that can be encompassed by a strap, and in particular to quick release strap mounts utilizing a cable tie strap with teeth engaging a locking wedge.

BACKGROUND OF THE INVENTION

One-piece cable ties utilizing a cable tie strap with teeth engaging a locking wedge are generally well-known for securing a bundle of wires or cables. Cable ties are well known and generally include an elongated strap body integrally formed with a head having a strap body passageway which includes a strap body locking mechanism for securing the strap body around a bundle of wires or cables.

However, known cable tie apparatuses only wrap wires and cables and do not provide mounting of other devices except by routing the cable tie's strap body over the device and securing it to the bundle of wires or cables.

SUMMARY OF THE INVENTION

The present invention is a releasable strap mount having a strap body and a cooperating locking head. The strap body is elongated between first and second ends with an outer interlock engagement member positioned adjacent to the first end. The locking head has an interface surface and an opposite external interconnect, and a passageway extended therethrough that is sized to accept the strap body lengthwise therethrough. The locking head also has an interlock member for releasably interlocking with the outer interlock engagement member of the strap body within the passageway. A releasable rotation coupling is formed between the locking head and the second end of the strap body. The strap body has a plurality of intervening coupling members spaced at intervals along a length thereof, and the strap body is divisible adjacent to each of the intervening coupling members between the intervening coupling member and its second end for shortening the strap body.

According to one aspect of the invention, a method of making the releasable strap mount is disclosed.

Other aspects of the invention are detailed herein.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein:

FIG. 5 is a cross-section view of the strap mount mounted on an external bar;

FIG. 5A illustrates operation of the strap mount wherein cooperating interlock member of the locking head engages and matingly interlocks with an outer interlock engagement member of the strap body for retaining the strap body within the locking head; and FIG. 6 is another cross-section views of the strap mount mounted on the external bar.

DETAILED DESCRIPTION OF PREFERRED EMBODIMENT

As required, a detailed illustrative embodiment of the present releasable strap mount is disclosed herein. However, techniques, systems and operating structures in accordance with the present releasable strap mount may be embodied in a wide variety of forms and modes, some of which may be quite different from those in the disclosed embodiment. Consequently, the specific structural and functional details disclosed herein are merely representative, yet in that regard, they are deemed to afford the best embodiment for purposes of disclosure and to provide a basis for the claims herein which define the scope of the present releasable strap mount. The following presents a detailed description of an illustrative embodiment of the present releasable strap mount.

In the Figures, like numerals indicate like elements.

Figure 1:
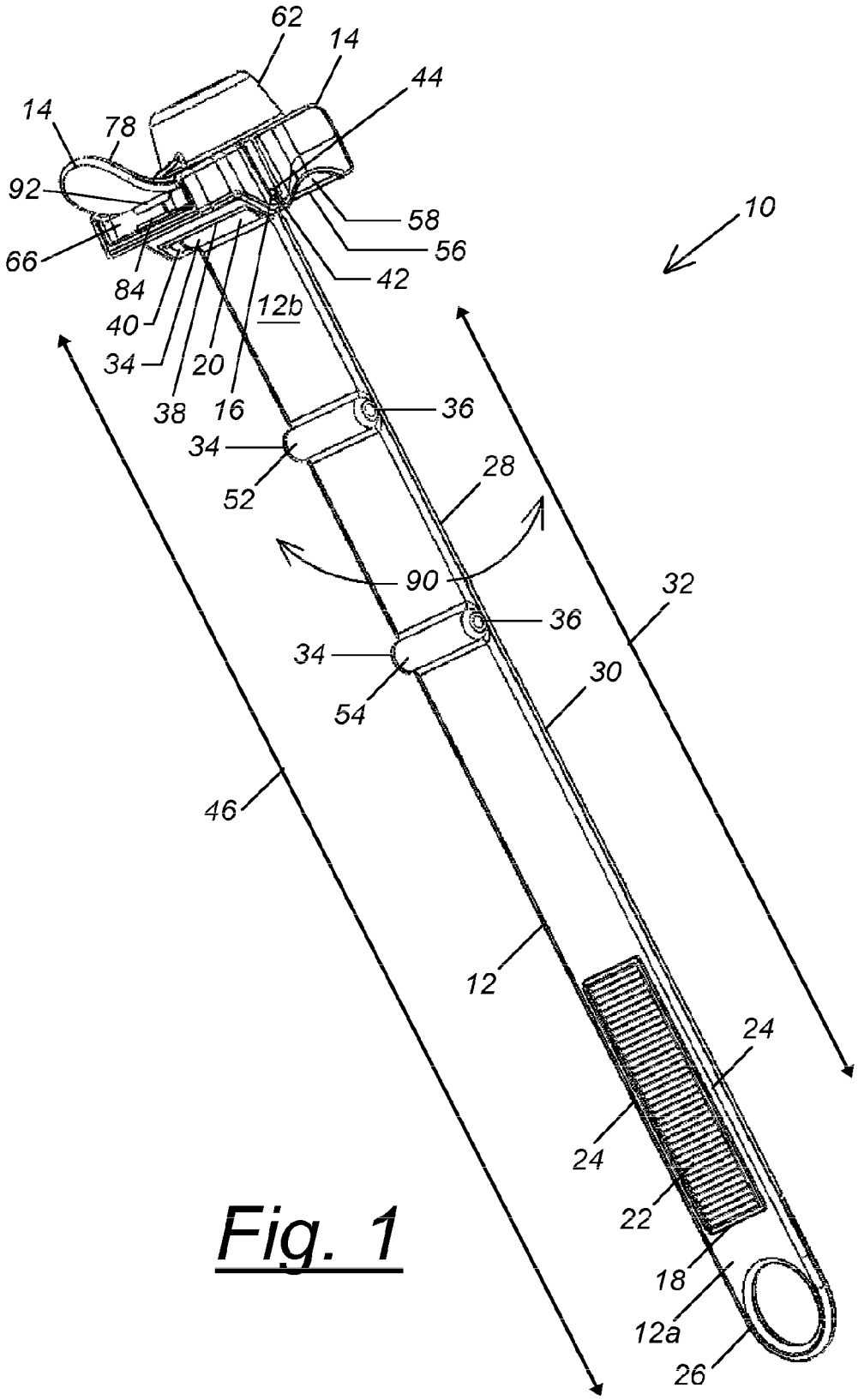
FIG. 1 is a perspective view showing an example of the strap mount of the invention.

FIG. 1 shows one illustrative embodiment of the present releasable strap mount 10 having an elongated strap body 12 extended from a locking head 14. and partially rotatably coupled thereto through a releasable rotation coupling 16, whereby strap body 12 is substantially flexible and partially rotatable relative to locking head 14.

Elongated strap body 12 is formed with a first end 12*a* and a second end 12*b* opposite first end 12*a*. Strap body 12 includes an outer interlock engagement member 18 positioned at least adjacent to first end 12*a*, and a coupling member 20 formed adjacent to second end 12*b*. For example, outer interlock engagement member 18 is formed of a plurality of individual teeth 22 oriented substantially crosswise of strap body 12 and substantially uniformly extended between a pair of side rails 24 positioned at least adjacent to first end 12*a* of strap body 12 and extending longitudinally there along. Strap body 12 is optionally terminated at its first end 12*a* in a manual strap tightening grip member 26, for example serrations substantially of the type described by O'Young, et al. in U.S. Pat. No. 6,807,714, incorporated by reference herein above, or a pull ring as shown. Strap body 12 is formed of a substantially non-stretch material, such as thermoplastic or metal, which can be formed around a target mount. For example, strap body 12 may be molded from a suitable polymeric thermoplastic material such as nylon. However, strap body 12 is optionally molded from different grades of nylon and non-nylon materials are also contemplated and may be substituted without deviating from the scope and intent of the present invention. Strap body 12 optionally includes a rubberized or otherwise substantially compressible anti-slip mechanism 28 coupled or adhered to an inner target engaging surface 30 thereof opposite from outer interlock engagement member 18. Anti-slip mechanism 28 optionally extends along substantially an entire length 32 of inner target engaging surface 30 of strap body 12.

Strap body 12 is releasably coupled to locking head 14 through partially rotatable rotation coupling 16 therebetween. For example, coupling member 20 of strap body 12 is formed of a part-cylindrical coupler body 34 having a longitudinal tubular passage 36 therethrough. Optionally, tubular passage 36 either extends completely through coupler body 34, else two tubular passages 36 extend partway through coupler body 34 and each terminates therewithin without intersecting. Part-cylindrical coupler body 34 is inserted into a mating socket 38 of locking head 14 through a wide angle mouth portion 40 such that tubular passage 36 substantially aligns with a corresponding passage 42 formed in locking head 14 adjacent to opposite ends of coupling member 20. When alignment is substantially achieved, an interconnect pin or axle 44 is removably inserted through tubular passage 36 and corresponding passage 42. Thereafter, coupling member 20 is interconnected with socket 38 in partially rotatably rotation coupling 16 for coupling strap body 12 with locking head 14 in a partially rotatable manner.

Strap body 12 is optionally formed of any desired initial overall length 46. According to one embodiment, initial length 46 of strap body 12 is shortenable to any of a plurality of various shorter lengths 48, 50. For example, strap body 12 is formed with one or a plurality of alternative intervening coupling members 52, 54 at optionally regular intervals along its length 46 corresponding to shorter lengths 48, 50, respectively. Similarly to coupling member 20 each intervening coupling member 52, 54 is formed of part-cylindrical coupler body 34 having longitudinal tubular passage 36 formed therethrough. Optionally, tubular passage 36 either extends completely through coupler body 34, else two tubular passages 36 extend partway through coupler body 34 and each terminates therewithin without intersecting.

Figure 2:
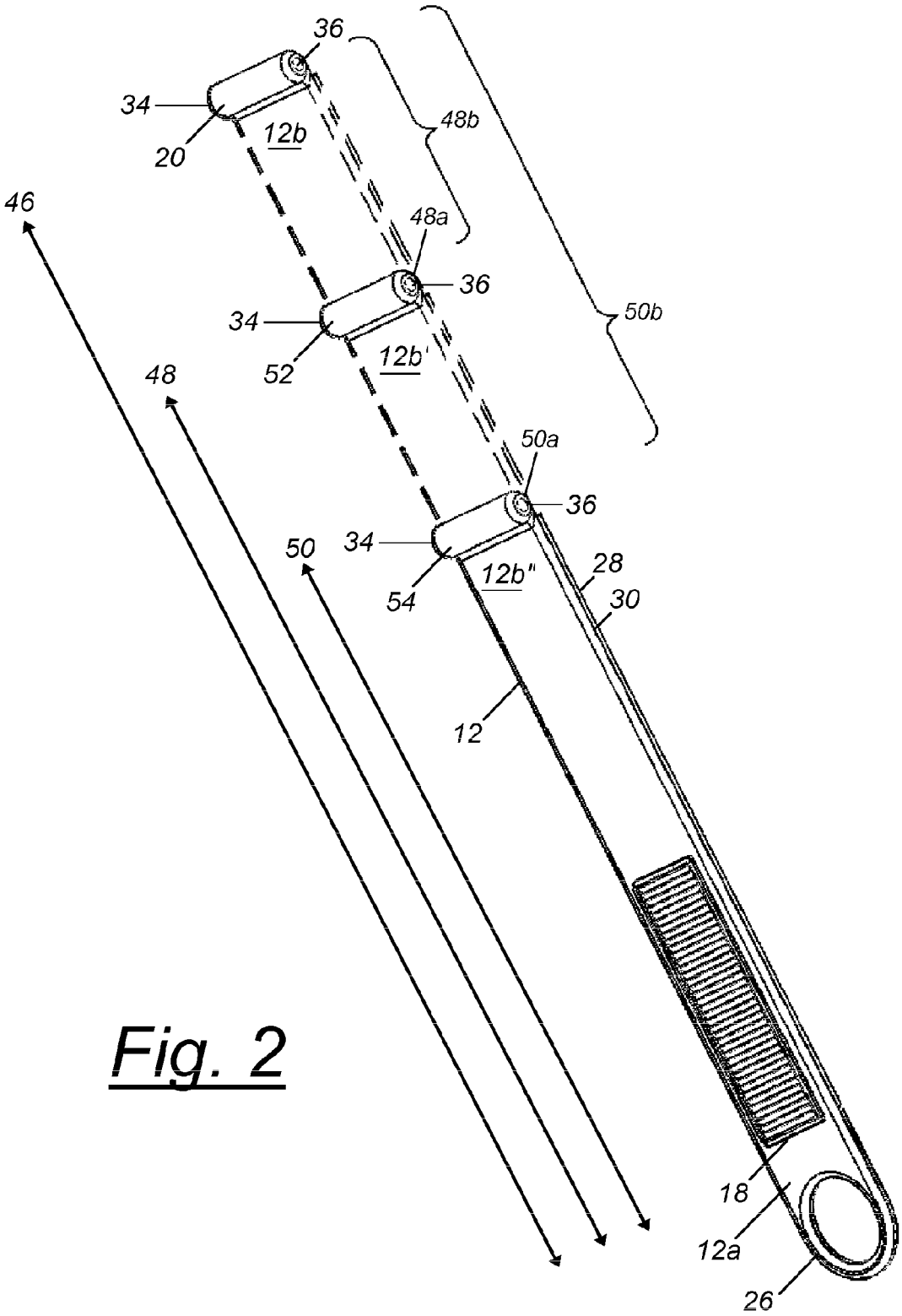
FIG. 2 illustrates a strap body of the strap mount being shortenable to any of various shorter lengths.

FIG. 2 illustrates initial length 46 of strap body 12 is divisible at a respective dividing line 48*a* or 50*a* adjacent to respective intervening coupling member 52, 54 positioned along length 46, whereby strap body 12 is shortenable to any of various shorter lengths 48, 50. Removal of a shorter portion 48*b*, or a longer portion 50*b* of second end 12*b* of strap body 12 from extreme distal coupling member 20 to respective dividing line 48*a* or 50*a* results in one of shorter lengths 48, 50 that is the same or longer than a desired shorter length from first end 12*a*. After removal of extreme second end 12*b* of strap body 12, the most extreme of coupling member 52, 54 remaining is trimmed to a substantially smooth, part-cylindrical surface about coupler body 34. Remaining coupling member 52, 54 of strap body 12 distal from first end 12*a* thereof is de facto second end 12*b*' or 12*b*" of strap body 12, and remaining distal coupling member 52, 54 is subsequently inserted into mating socket 38 of locking head 14 in place of coupling member 20. Resultant initial strap length 46, or shorter length 48, 50 is selected to encompass a target mounting structure with outer interlock engagement member 18 positioned such that a portion thereof engages an interlock member 78 of locking head 14 when installed on the target mounting structure, as disclosed herein. Thereafter, strap body 12 with initial length 46 or selected one of shorter lengths 48, 50 is releasably coupled to locking head 14 through partially rotatable rotation coupling 16 therebetween. Optionally, more or fewer intervening coupling members may be provided such that initial length 46 of strap body 12 is longer or shorter.

Figure 3:
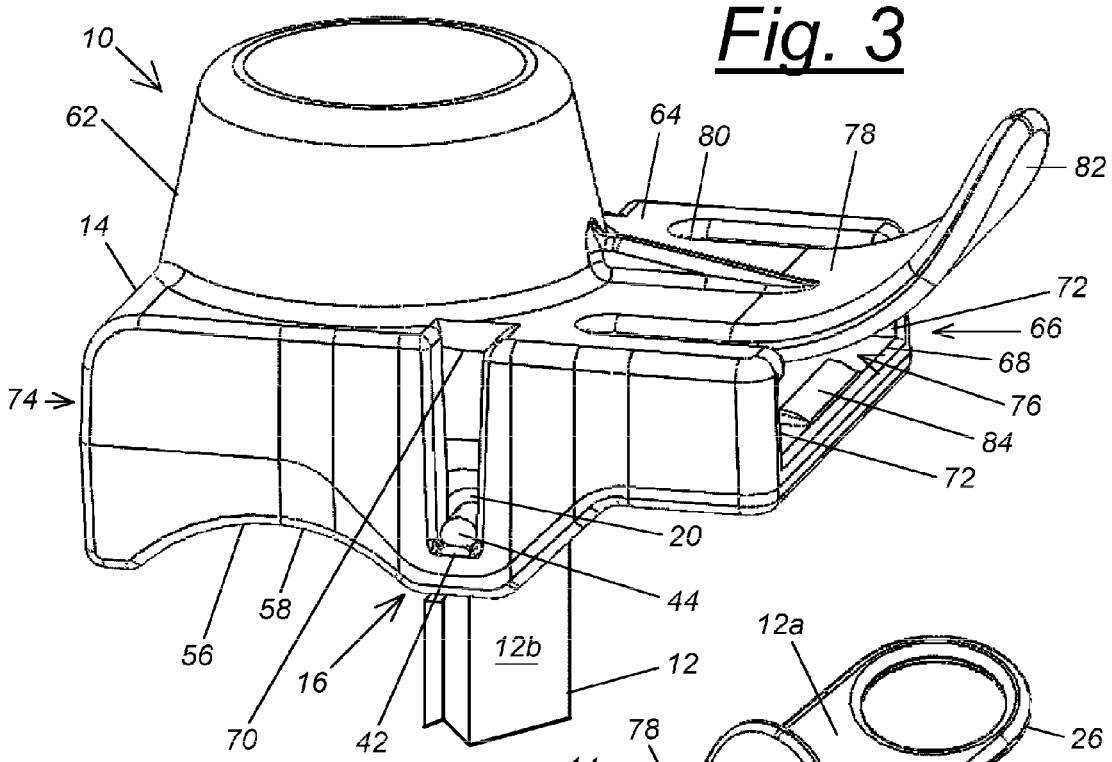
FIG. 3 is a close up of the locking head of the strap mount.

FIG. 3 is a close up of locking head 14 having a lower interface portion 56 formed with a target interface surface 58 for engaging a target surface 60 external of strap mount 10, as disclosed herein, and an external interconnect 62 formed on an upper cover portion 64 opposite therefrom. Target interface surface 58 is optionally substantially concavely arcuate (shown) for engaging a convexly curved target surface 60. External interconnect 62 is any desired interconnect structure suitable for interconnectably receiving an external object or device to be mounted on external target surface 60 via strap mount 10. For example, external interconnect 62 is any of but not limited to: a conventional threaded stud or female thread for receiving a screw or bolt thereinto, a substantially smooth and planar suction cup mounting surface such as disclosed by the inventor of the present invention in copending U.S. patent application Ser. No. 12/006,386 filed Jan. 2, 2008, which is incorporated herein by reference, and a ball coupler as disclosed by the inventor of the present invention in U.S. Pat. No. 5,845,885, which is incorporated herein by reference.

Rotation coupling 16 between strap body 12 and locking head 14 is illustrated by example and without limitation as coupler body 34 of the extreme distal one of coupling member 20, 52, 54 being inserted into socket 38 of locking head 14. Tubular passage 36 of coupling member 20, 52, 54 is substantially aligned with corresponding passage 42 of locking head 14. Here, corresponding passage 42 of locking head 14 is illustrated by example and without limitation as a slot (shown) terminated by interface portion 56 adjacent to target interface surface 58 approximately in the middle of locking head 14 and substantially opposite from external interconnect 62.

Locking head 14 forms a substantially rectangular strap body passageway 66 open therethrough between target interface surface 58 and external interconnect 62 and sized to accept strap body 12 lengthwise therethrough. Strap body passageway 66 is formed of a compression surface 68 adjacent and spaced above interface surface 58 of locking head 14 and a substantially opposing cover surface 70 opposite and spaced away from compression surface 68. Compression surface 68 and cover surface 70 extend between spaced apart side walls 72. Strap body passageway 66 terminates at a first end in a wide strap inlet mouth 74 (more clearly shown in subsequent views) and terminates at a second opposite end in a narrow strap outlet mouth 76 at opposite ends of locking head 14.

Locking head 14 further comprises an interlock member 78 adjacent to the strap outlet mouth 76 and structured to matingly interlock with outer interlock engagement member 18 of strap body 12. Interlock member 78 is formed as a resiliently flexible lever arm cantilevered at a root portion 80 thereof from locking head 14 cover portion 64 and having a thumb plate 82 distal from root portion 80 for manual release of interlock. Locking head 14 may optionally include a tensioner member 84 on compression surface 68 of strap body passageway 66 adjacent to strap outlet mouth 76 and substantially opposite of interlock member 78, as more clearly shown in FIG. 5 and blow-up of FIG. 5A. Tensioner member 84 is positioned for interacting with anti-slip mechanism 28 of inner target engaging surface 30 of strap body 12 for maintaining engagement tension between engaged interlock member 78 of locking head 14 and outer interlock engagement member 18 of strap body 12. Tensioner member 84 thereby assists in preventing retrograde movement of strap body 12 within strap body passageway 66. For example, tensioner member 84 is one wide tooth (shown) or a plurality of teeth oriented substantially crosswise of passageway 66 between opposing side walls 72 and facing away from strap outlet mouth 76 and toward strap inlet mouth 74.

Figure 4:
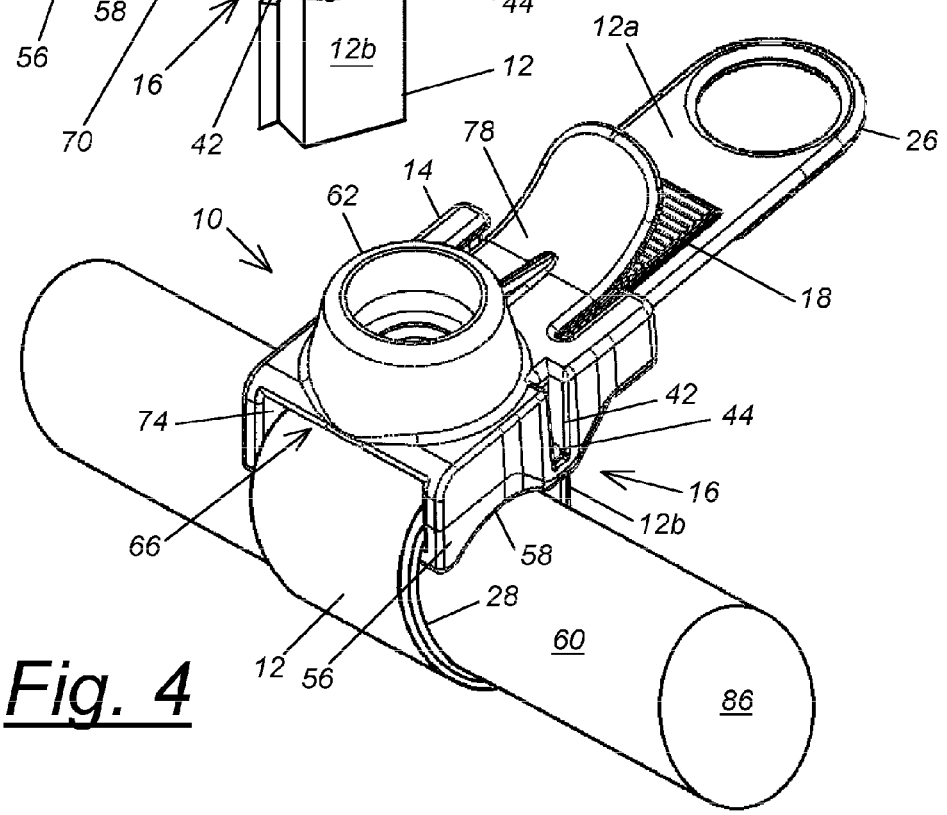
FIG. 4 illustrates operation of the strap mount of the invention.

FIG. 4 illustrates operation of strap mount 10. In operation, in no definite order, locking head 14 is placed with target interface surface 58 of interface portion 56 thereof engaging the surface 60 of an external bar 86, and strap body 12 wrapped once around bar 86 with substantially anti-slip mechanism 28 of inner target engaging surface 30 engaged with surface 60 of bar 86. Insert manual strap tightening grip member 26 (if present) at first end 12*a* of strap body 12 into strap inlet mouth 74 of strap body passageway 66 in locking head 14, and feed strap body 12 through strap body passageway 66 and out through strap outlet mouth 76 until inner target engaging surface 30 is fully engaged with surface 60 of bar 86. Manually tighten strap body 12 on bar 86 by pulling on first end 12*a* of strap body 12 or manual strap tightening grip member 26 (if present) until strap mount 10 firmly grips surface 60 of bar 86. An external object or device is mounted on strap mount 10 via connection with external interconnect 62 on cover portion 64 thereof.

FIG. 5 and FIG. 6 are cross-section views of strap mount 10 mounted on external bar 86. FIG. 5A is a blow-up view showing operation of outer interlock engagement member 18 of strap body 12 and cooperating interlock member 78. Here, target interface surface 58 of interface portion 56 of locking head 14 is illustrated engaging surface 60 of external bar 86. Optionally, target interface surface 58 of interface portion 56 is provided with an interface member 88 coupled or adhered thereto, which mutually protecting locking head 14 and bar 86 from scratching or damage. Optionally, interface member is a rubberized or otherwise substantially anti-slip mechanism (FIG. 5) that additionally encourages stable positioning of locking head 14 on surface 60 of bar 86, while providing mutual damage protection.

Strap body 12 is illustrated as having part-cylindrical coupler body 34 of coupling member 20 inserted into mating socket 38 of locking head 14, and tubular passage 36 is aligned with corresponding passage 42 of locking head 14. Interconnect pin 44 is removably inserted through mutually aligned tubular passage 36 corresponding passage 42 of locking head 14 for forming partially rotatable rotation coupling 16 therebetween. Thereafter, strap body 12 is rotatable (arrow 90) through rotation coupling 16 within wide angle mouth portion 40 of socket 38 for rotating partially about locking head 14 for engaging bar 86 of larger or smaller sizes. Although illustrated as cylindrical in cross-section bar 86 is alternately square, rectangular or non-uniform in cross-section with the only requirement being that elongated strap body 12 is sufficiently long to encompass bar 86 and still engage locking head 14, as disclosed herein.

Interlock member 78 of locking head 14 is further illustrated here as forming a cooperating interference member 92 structured to interfere with retrograde movement of strap body 12 within strap body passageway 66. For example, interference member 92 is one wide tooth or a plurality of teeth positioned within and partially occluding strap body passageway 66 substantially opposite of tensioner member 84 on compression surface 68. Tooth or teeth of interference member 92 is oriented substantially crosswise of passageway 66 between opposing side walls 72 and facing away from strap outlet mouth 76 and toward strap inlet mouth 74 into notches between teeth 22 in a position to engage and matingly interlock with in outer interlock engagement member 18 of strap body 12. Furthermore, resilient cantilevered lever arm of interlock member 78 exerts a compression force (arrow 94) on outer interlock engagement member 18 of strap body 12 for maintaining engagement of interference member 92 with outer interlock engagement member 18 of strap body 12. Furthermore, compression force 94 compresses strap body 12 against compression surface 68 of strap body passageway 66 and presses inner target engaging surface 30 of strap body 12 into compressive engagement with tensioner member 84 on compression surface 68 thereof. Accordingly, while interference member 92 of interlock member 78 engages outer interlock engagement member 18 of strap body 12, tensioner member 84 cooperates with opposing compressible anti-slip mechanism 28 on inner target engaging surface 30 thereof both to directly interfere with retrograde movement of strap body 12, and to press outer interlock engagement member 18 of strap body 12 into more secure interlocking engagement with interference member 92 of interlock member 78. Therefore, locking head 14 is securely positioned on surface 60 of target mounting bar 86.

Interference member 92 is resiliently dislocatable (arrow 96) from partially occluding strap body passageway 66 by operation of resiliently flexible cantilevered lever arm of interlock member 78, whereupon interference member 92 disengages from outer interlock engagement member 18 of strap body 12 and permits heretofore prevented retrograde movement of strap body 12 within strap body passageway 66 and subsequent loosening and removal of strap mount 10 from target mounting bar 86.

Optionally, inner target engaging surface 30 of strap body 12 is formed with an inner interlock engagement member 98 positioned at least adjacent to first end 12*a* thereof opposite from outer interlock engagement member 18. For example, inner interlock engagement member 98 is formed of a plurality of teeth oriented substantially crosswise of strap body 12 and substantially uniformly extended longitudinally there along. Plurality of teeth of inner interlock engagement member 98 protrudes from surface of anti-slip mechanism 28 on inner target engaging surface 30 of strap body 12 for ready engagement with tensioner member 84 on compression surface 68 of strap body passageway 66. Alternatively, plurality of teeth of inner interlock engagement member 98 operate to resist compression of compressible anti-slip mechanism 28 of inner target engaging surface 30 of strap body 12 when interference member 92 of interlock member 78 of locking head 14 engages outer interlock engagement member 18 of strap body 12, as disclosed herein, thereby securing engagement of interlock member 78 with outer interlock engagement member 18 of strap body 12. Individual ones of plurality of teeth of inner interlock engagement member 98 are optionally extended longitudinally of strap body 12, as shown, thereby resisting deflection of outer interlock engagement member 18 of strap body 12 during engagement with interference member 92 of interlock member 78 of locking head 14.

FIG. 5A illustrates operation of cooperating interference member 92 of interlock member 78 engaged and matingly interlocked with teeth 22 in outer interlock engagement member 18 of strap body 12 within strap outlet mouth 76 for interfering with retrograde movement of strap body 12 within strap body passageway 66. FIG. 5A also illustrates operation of substantially opposing tensioner member 84 interacting with anti-slip mechanism 28 of inner target engaging surface 30 for maintaining engagement tension between engaged interlock member 78 of locking head 14 and outer interlock engagement member 18 of strap body 12.

While the preferred and additional alternative embodiments of the invention have been illustrated and described, it will be appreciated that various changes can be made therein without departing from the spirit and scope of the invention. Therefore, it will be appreciated that various changes can be made therein without departing from the spirit and scope of the invention. Accordingly, the inventor makes the following claims.

What is claimed is:

1. A releasable strap mount, comprising:

a strap body comprising a first end and a second end with an interlock engagement member positioned at least adjacent to the first end;

a locking head comprising an interface surface and an external interconnect, and a strap body passageway extended therethrough, wherein:

the strap body passageway is further sized to accept the strap body lengthwise therethrough, and the locking head further comprises an interlock member coupled for releasably interlocking with the interlock engagement member of the strap body within the strap body passageway; and a releasable coupling between the locking head and the second end of the strap body, the releasable coupling further comprising a removable interconnect member that is interconnectable between the second end of the strap body and the locking head for releasably interconnecting the second end of the strap body and the locking head.

2. The releasable strap mount of claim 1, wherein releasable coupling further comprises: a coupling member formed on the strap body adjacent to the second end thereof, a mating socket formed in the locking head adjacent to the interface surface thereof, and wherein the removable interconnect member further comprises a removable interconnect pin releasably interconnecting the coupling member relative to the mating socket.

3. The releasable strap mount of claim 2, wherein the strap body further comprises at least one intervening coupling member spaced between the first and second ends thereof, the strap body being divisible adjacent to the intervening coupling member between the intervening coupling member and the second end of the strap body.

4. The releasable strap mount of claim 2, wherein the strap body further comprises a plurality of intervening coupling members spaced at intervals along a length thereof, the strap body being divisible adjacent to each of the intervening coupling members between the intervening coupling member and the second end of the strap body.

5. The releasable strap mount of claim 1, wherein the strap body further comprises an anti-slip mechanism coupled to an inner target engaging surface thereof opposite from the interlock engagement member positioned on an outer portion of the strap body.

6. The releasable strap mount of claim 1, wherein the locking head further comprises a tensioner member substantially opposite of the interlock member.

7. The releasable strap mount of claim 1, wherein the interlock member of the locking head further comprises a resiliently flexible lever arm coupled to the locking head.

8. The releasable strap mount of claim 7, wherein the resiliently flexible lever arm of the interlock member is further coupled to the locking head adjacent to a strap outlet mouth of the strap body passageway extended therethrough.

9. The releasable strap mount of claim 8, wherein the interlock engagement member of the strap body further comprises a plurality of individual teeth oriented substantially crosswise of the strap body; and wherein the resiliently flexible lever arm of the interlock member further comprises an interference member cooperating with the teeth of the interlock engagement member of the strap body.

10. A releasable strap mount, comprising:

a substantially flexible strap body elongated between a first end and a second end opposite the first end, wherein the strap body further comprises an inner target engaging surface positioned on an inner surface thereof, an outer interlock engagement member positioned on an outer surface thereof opposite from the inner surface and at least adjacent to the first end, a coupling member formed adjacent to the second end, and at least one intervening coupling member positioned between the first and second ends, and the strap body being divisible adjacent to the intervening coupling member between the intervening coupling member and the second end of the strap body;

a locking head comprising a substantially arcuate interface surface and an external interconnect opposite therefrom, and forming a strap body passageway therethrough positioned substantially between the interface surface and the external interconnect, wherein the strap body passageway is further sized to accept the strap body lengthwise therethrough, and further comprises a compression surface adjacent to the interface surface and a substantially opposing cover surface opposite thereof and spaced away therefrom, the compression and cover surfaces being formed between spaced apart side walls and extended between a wide strap inlet mouth and a narrow strap outlet mouth at opposite ends of the strap body passageway, wherein the locking head further comprises an interlock member positioned adjacent to the strap body passageway to matingly interlock with the outer interlock engagement member of the strap body, wherein the locking head further comprises a tensioner member formed in the strap body passageway substantially opposite from the interlock member to interact with the inner target engaging surface of the strap body for preventing retrograde movement thereof relative to the locking head when the interlock member is engaged with the outer interlock engagement member of the strap body, and wherein the locking head further comprises a socket formed in the locking head adjacent to the interface surface thereof and sized to receive thereinto the coupling member of the strap body; and a releasable coupling between the locking head and the coupling member of the strap body.

11. The releasable strap mount of claim 10, wherein the releasable coupling further comprises a removable and replaceable interconnect pin releasably interconnecting the coupling member in an at least partially rotatable manner relative to the mating socket.

12. The releasable strap mount of claim 10, wherein the outer interlock engagement member of the strap body further comprises an a plurality of teeth arranged substantially crosswise between a pair of side rails extending longitudinally along the strap body.

13. The releasable strap mount of claim 12, wherein the interlock member further comprises a lever arm adjacent to the strap outlet mouth and forming at least a tooth intersecting the strap body passageway adjacent to the strap outlet mouth and positioned to matingly interlock with the teeth of the outer interlock engagement member of the strap body.

14. The releasable strap mount of claim 10, wherein the inner target engaging surface of the strap body further comprises a rubberized anti-slip target engaging surface coupled thereto, and a manual strap tightening grip adjacent to the second end thereof.

* * * * *